US008032951B1

(12) United States Patent
Nestberg et al.

(10) Patent No.: US 8,032,951 B1
(45) Date of Patent: Oct. 11, 2011

(54) DETACHABLE POCKET SYSTEM

(76) Inventors: Paul V. Nestberg, Greenville, SC (US); Heather H. Tapp, Greenville, SC (US)

( * ) Notice: Subject to any disclaimer, the term of this patent is extended or adjusted under 35 U.S.C. 154(b) by 277 days.

(21) Appl. No.: 12/383,435

(22) Filed: Mar. 24, 2009

(51) Int. Cl.
*A41D 27/20* (2006.01)

(52) U.S. Cl. ..... 2/247; 2/69; 2/79

(58) Field of Classification Search ..... 2/93, 94, 2/247, 251, 253, 48, 51, 49.5, 49.2, 52, 69, 2/69.5, 77, 79, 85, 88, 89, 95, 102, 108, 114, 2/115, 120, 227, 248–250, 252; 224/583, 224/901.2, 901.8, 660, 665, 230, 247
See application file for complete search history.

(56) References Cited

U.S. PATENT DOCUMENTS

| | | | | | |
|---|---|---|---|---|---|
| 1,708,786 | A | * | 4/1929 | Cohen | 2/247 |
| 2,557,445 | A | * | 6/1951 | Lewallen | 2/247 |
| 2,846,685 | A | * | 8/1958 | Ehrich | 2/51 |
| 3,438,062 | A | * | 4/1969 | Dobell | 2/247 |
| 3,537,108 | A | * | 11/1970 | Daniels | 2/252 |
| 3,624,686 | A | | 11/1971 | Beals | |
| 3,968,522 | A | | 7/1976 | Riess | |
| 3,994,025 | A | * | 11/1976 | Petroski | 2/20 |
| 4,058,853 | A | * | 11/1977 | Boxer et al. | 2/239 |
| 4,218,781 | A | * | 8/1980 | Lieberman | 2/247 |
| 4,444,342 | A | | 4/1984 | Powell | |
| 4,532,656 | A | * | 8/1985 | Suzuki | 2/247 |
| 4,651,355 | A | * | 3/1987 | White | 2/247 |
| 4,710,979 | A | | 12/1987 | Bull et al. | |
| 4,791,681 | A | | 12/1988 | Dean | |
| 5,003,637 | A | | 4/1991 | Lonon | |
| 5,054,127 | A | | 10/1991 | Zevchak | |
| 5,063,614 | A | * | 11/1991 | McSheffery | 2/94 |
| 5,067,178 | A | | 11/1991 | Katchka | |
| 5,075,902 | A | | 12/1991 | McReynolds et al. | |
| 5,394,565 | A | * | 3/1995 | Stewart et al. | 2/69 |
| 5,517,696 | A | | 5/1996 | Krugler | |
| 5,526,535 | A | * | 6/1996 | Dobrzenski | 2/102 |
| 5,718,000 | A | * | 2/1998 | Ost et al. | 2/69 |
| 5,832,536 | A | * | 11/1998 | Kramer | 2/69 |
| 5,991,925 | A | * | 11/1999 | Wu | 2/102 |
| 6,233,747 | B1 | * | 5/2001 | Barker | 2/247 |
| 7,114,190 | B2 | * | 10/2006 | Najarian et al. | 2/48 |
| 7,464,413 | B2 | | 12/2008 | Todd | |
| 2005/0188450 | A1 | * | 9/2005 | Clark | 2/247 |
| 2008/0034478 | A1 | * | 2/2008 | Patterson | 2/239 |
| 2010/0083422 | A1 | * | 4/2010 | Lebl | 2/251 |

* cited by examiner

*Primary Examiner* — Amy Vanatta
(74) *Attorney, Agent, or Firm* — McNair Law Firm, P.A.; Seann P. Lahey

(57) ABSTRACT

A system of removably securing pockets with garments, vehicles, walls, etc. The system includes a plurality of attachment units which are arranged in selected locations over a surface. Each attachment unit includes at least one tab. Each tab comprises a first end permanently secured with the surface and a second end extending outwardly from the first end. The second end is operable to pivot into a superimposed position over the first end and to a position parallel with the first end. The pocket includes a plurality of longitudinal edges and outer and inner sides. Fastener members are secured along the outer and inner sides and adjacent selected of the edges of the surface. In use, the first and second ends of the tabs are separated from the superimposed positions allowing the fastener members along the inner side of the pocket to be secured with the fastener members carried by the first end of the tab. The second ends of the tabs may then be folded over the edges of the pocket causing the fasteners carried by the second ends of the tab to engage with the fasteners carried by the outer side of the pocket. The system causes the fasteners on both sides of the pocket to be engaged with the garment.

15 Claims, 2 Drawing Sheets

DETACHABLE POCKET SYSTEM

BACKGROUND OF THE INVENTION

This invention is directed to a system for removably attaching pockets of various sizes, shapes and functions with primarily garments, but also with such things as walls, benches, seat backs, belts, etc.

It is a primary object of the invention to provide a system of pockets, which are primarily tool supporting pockets, and which are securely attachable in selected locations with and detachable from garments, thereby eliminating the need for heavy, cumbersome tool belts.

Another object of the invention is the provision of a plurality of attachment units for garments which include a closed position in which the fasteners of the attachment units are covered and an engaged position in which the fasteners of the attachment units are locked with a pocket securing that pocket with the garment.

Another object of the invention is the provision of attachment units carried by the garment which will engage simultaneously with both the inner and outer surfaces of the pocket providing that the pocket is securely fastened with the garment.

Another object of the invention is the provision of a system of pockets designed to each carry different tools or items such as cosmetics, toys, medicines, etc., but which are interchangeably securable with a garment.

SUMMARY OF THE INVENTION

A system providing garments with a plurality of pockets which are removable and interchangeable. The garment includes a plurality of attachment units arranged in selected locations over its outer surface. The attachment units include at least one tab.

Each tab comprises a first end permanently secured with the garment and a second end extending outwardly from the first end and which is operable to pivot into a superimposed position over the first end. The first and second ends each carry one of a hook and loop fastener such as VELCRO strips.

Each pocket has a plurality of longitudinal edges with outer and inner sides. A fastener member is secured along each of the outer and inner sides and adjacent at least one of the edges.

The first and second ends of each tab may be separated from the superimposed position into a receiving position. The receiving position allows the fastener along the inner side of the pocket to be secured with the fastener carried by the first end of the tab and the second end of the tab may be folded over the edge of the pocket allowing the fastener carried by the second end of the tab to engage with the fastener carried by the outer side of the pocket. This over and under engagement of the fasteners provides for the pocket to be securely held in position with the garment.

Each of the attachment units comprise a pair of vertically extending tabs and at least one horizontally extending tab.

Each fastener member carried by the first ends of the tabs are one of all loop members or all hook members and the fastener member carried by the inner side of the pocket are all the opposite of the first selected members. Also, the fastener member carried by the second ends of the tabs are the opposite of the first members and the fastener member carried by said outer side of the pockets are all the opposite of the second selected members.

The fastener members carried by the first and second ends of each tab are approximately of equal size. The fastener members of each attachment unit generally include a pair of spaced vertically extending fastener members of equal size and an intermediate fastener member of a different size. Generally, the intermediate fasteners are larger than the spaced fasteners.

The pocket includes spaced fastener members of a size substantially equal the size of the vertically extending spaced fasteners of the attachment unit and the intermediate fastener members are of a size substantially equal the size of the intermediate fastener members of the attachment unit.

A method of selectively securing pockets in selective locations with a garment including the steps of:

I. Providing a plurality of attachment units each having first and second fastener members and securing the units in selected positions about the garment;

II. Providing a pocket and securing fastener members along its selected edges in superimposed positions on its outer and inner sides;

III. Engaging the inner side fastener members of the pockets with the first fastener members of the unit and engaging the outer side fastener members with the second fastener members of the unit securely and releasably engaging the pocket with the garment.

It is preferred that the fastener members are hook and loop-type fastener members.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The instant invention is directed to a system of attachment units which are operable to removably secure pockets of various sizes and shapes with selected areas of garments. Generally, the garments comprise some type of work clothing such as coveralls, overalls, work shirts and pants; however, the invention is not limited to work clothing but could be used with any type clothing, or for that matter with various other support members such as with vehicle seats or walls, with work benches, etc. The pockets are primarily intended to be tool or work pockets for carrying implements or supplies of trade. They, too, are not so limited to the design shown and may be designed for any type of use, such as for cosmetics, portable communication means, medical equipment, children's toys, etc.

Figure 1:
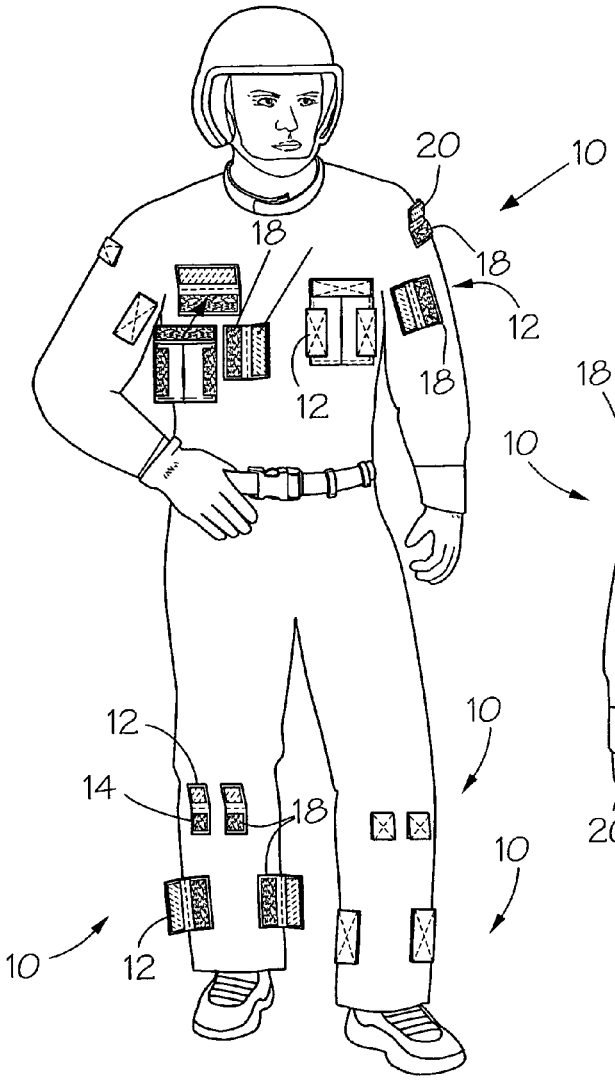
FIG. 1 is a front view of an exemplary detachable pocket arrangement utilizing the attachment units of the invention.
Figure 2:
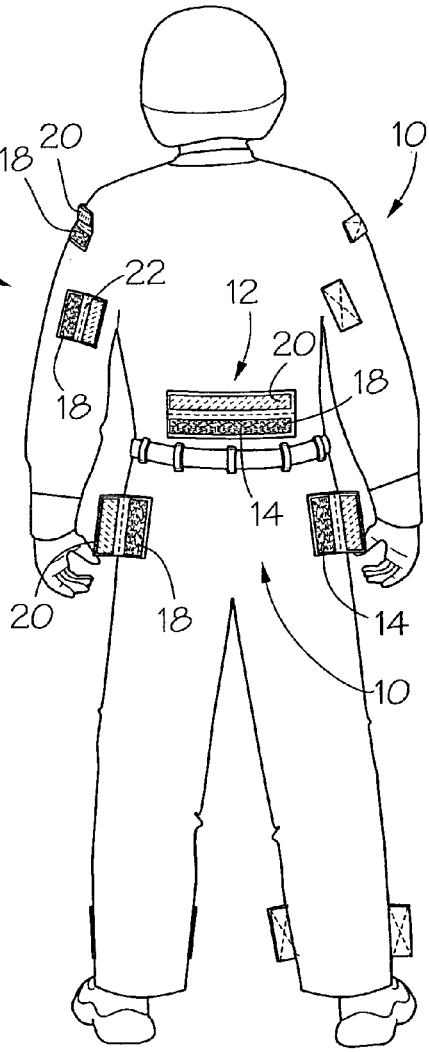
FIG. 2 is a rearview of an exemplary detachable pocket system of the invention.

Turning now to FIGS. 1 and 2, there is shown a human figure wearing a pair of coveralls. Secured with the coveralls are a plurality of attachment units 10.

Attachment units 10 are secured in selected areas over the garment to include the arms, the torso portion, the legs and the waist area of the garment. It is noted that these locations are only illustrative and may be changed or moved to accommodate the intended need. Each of the attachment units 10 may vary in size, again depending on the intended use.

Each attachment unit 10 comprises a plurality of tabs 12, i.e. at least three. Each tab comprises a first end 18, a second end 20 and a third folding section 22 therebetween. First end or section 18 is secured in fixed position with the garment while second end or section 20 is secured with a flexible strip. The flexible strip also includes folding section 22.

Each tab 12 has arranged at its first and second ends fastener members or strips 14 and 16 of the hook and loop-type, i.e. VELCRO. It is noted strips 14, secured with first end 18, is either the hook or loop-type fastener member. For convenience, all first end 18 fastener members 14 are here designated hook members. All second end 20 fastener members 16 are here designated as loop members. The arrangement could be reversed but all first end fasteners must be the same and all second end fasteners must be the same but opposite the first end fasteners.

This arrangement allows each tab 12 to be positioned in a closed position as shown in the right shoulder portion of FIG. 1. Here it is seen that second end 20 is superimposed over and secured with first end 18. This position presents a finished look when the tabs are not in use.

Figure 3:
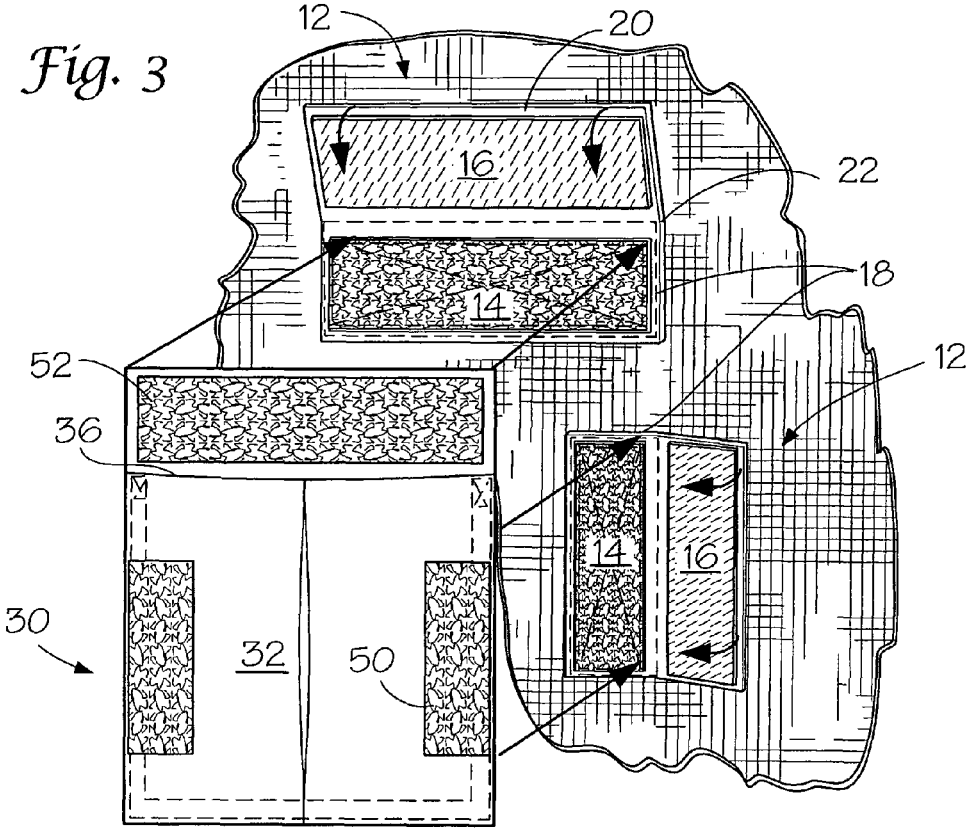
FIG. 3 is an exploded perspective view of a pocket associated with an attachment unit.

The receiving position for the tabs is shown in the waist area of FIG. 2 and in FIG. 3. In the receiving position, second ends 20 are laid back and separated from first ends 18. With tabs 12 in the receiving position, pockets 30 may be moved to engage lower side fastener members 54 and 56 with fastener strips 14 of first ends 18 of tabs 12.

It is noted that each first end 18 of tab 12 may comprise only a fastener strip 14 secured with the garment while second end 20 always comprises a flexible member to which fastener strip 16 is secured. The flexible member, preferably woven fabric, also forms the folding piece. The end of the flexible piece adjacent fastener strap 14 of first end 18 is secured with the fabric.

It is noted that more than one horizontally extending tab 12 may be utilized as indicated in FIG. 1 in the leg section. In each instance, the plurality of tabs are arranged along substantially the same horizontal axis. Vertically arranged tabs 12 may likewise be arranged as spaced plural members.

Figure 4:
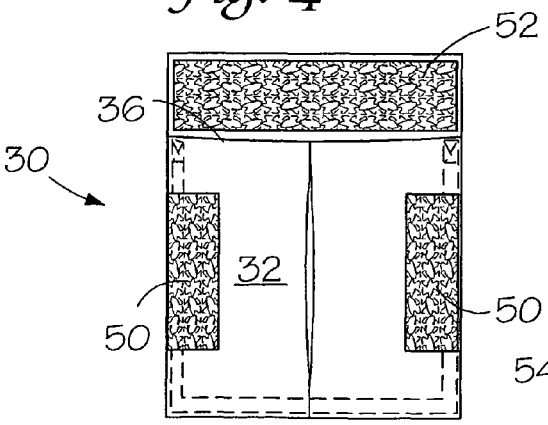
FIG. 4 is front view of an exemplary pocket.
Figure 5:
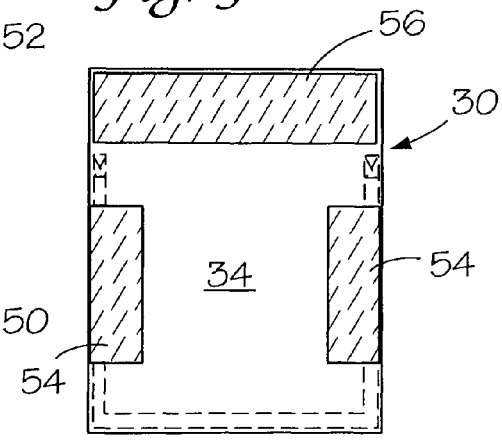
FIG. 5 is a back view of an exemplary pocket.

Turning now to FIGS. 3, 4 and 5, pocket 30 is shown first from its front or outer side 32 in FIGS. 3 and 4 and from its back or inner side 34 in FIG. 5. Pocket 30 includes a pair of vertical edges and a pair of horizontal edges. The pocket includes an opening at 36 providing access to the interior thereof.

It is noted that pocket 30 is of representative design and is not intended to show the many specific pocket constructions and sizes which may be used to accommodate the various implements and items contemplated. Regardless of the capabilities and configurations of the pockets, the structure used to attach and release them from the garments is substantially the same and in accordance with the concept of this invention.

Pocket 30 has secured along its upper edge on both the outer and inner faces 32, 34 a strip of hook and loop fastener comprising a fastener member. The fastener members secured with the outer side 32 comprise fastener strips 50 which are secured adjacent opposed outer vertical edges and fastener strip 52 secured along the upper edge of outer surface 32. On inner side 34 of the pocket is secured a pair of fastener strips 54 along opposed vertical edges in superimposed positions with fastener strips 50. Along the upper edge of the pocket fastener strip 56 is secured in superimposed positions with fastener strip 52. All fastener strips on outer surface 32 are the hook-type fastener members intended to be engaged with loop-type fastener strips 16 on second end 30, while the inner side 34 of the pocket fastener strips 54 are all loop-type fastener members intended to engage with the hook-type fastener members 14 carried by the first end 18.

Pocket 30, as best seen in FIG. 3, is moved into position over both the vertical and horizontal first ends 18 positioning fastening strips 54 and 56 in engagement with fastener strips 14 and 16 firmly positioning pocket 30 with the garment. Second ends 20 are now moved to the closed position causing fastener members 16 to engage with fastener members 50 and 52 positively securing pocket 30 with the garment.

When locked in position, as described, a force generally sufficient to tear the garment is required to dislodge the pocket.

While a preferred embodiment of the invention has been described using specific terms, such description is for illustrative purposes only, and it is to be understood that changes and variations may be made without departing from the spirit or scope of the following claims.

What is claimed is:

1. A system for providing a garment with interchangeable pockets comprising:

a plurality of attachment units arranged in selected locations over said garment, each said unit having a plurality of tabs including a pair of vertically extending tabs and at least one horizontally extending tab arranged intermediate said vertically extending tabs;

each said tab comprising a first end permanently secured with said garment and a second end extending outwardly from said first end and operable to pivot into a superimposed position over said first end, said first and second ends each carrying one of a hook and loop fastener;

a pocket having a plurality of longitudinal edges and outer and inner sides;

a fastener member secured on each of said outer and inner sides of said pocket adjacent at least one of said edges; wherein, said first and second ends of a selected of said tabs may be separated from said superimposed position allowing said fastener member along said inner side of said pocket to be secured with said fastener member carried by said first end, said second end may be folded over an edge of said edges causing said fastener member carried by said second end to engage with said fastener member carried by the outer side of said pocket securely locking said pocket with said garment.

2. The system as set forth in claim 1 wherein said fastener members carried by said first ends are all hook members and said fastener members carried by said inner side are all loop members.

3. The system as set forth in claim 1 wherein said fastener members carried by said second end are all loop members and said fastener members carried by said outer side are all hook members.

4. The system as set forth in claim 1 wherein said units are of different sizes to accommodate different size pockets.

5. The system as set forth in claim 1 wherein said vertically extending tabs are arranged in spaced vertically extending positions.

6. The system as set forth in claim 1 wherein said fasteners carried by each said tab are approximately equal size.

7. The system as set forth in claim 1 wherein said units each include spaced fasteners of substantially equal size and at least one intermediate fastener of a different size.

8. The system as set forth in claim 1 wherein said pocket includes spaced fasteners of a size substantially equal the size of said fasteners of said vertically extending tabs and intermediate fasteners of a size substantially equal the size of said fasteners of said horizontally extending tab.

9. The system as set forth in claim 7 wherein said intermediate fasteners are larger than said spaced fasteners.

10. A method of selectively securing pockets in selective locations of a garment comprising the steps of:

providing a plurality of attachment units each having a pair of vertically extending tabs and at least one horizontally extending tab arranged intermediate said vertically extending tabs and each of said tabs having first and second fastener members;

securing said units in selected positions on said garment;

providing a plurality of pockets of selected configurations and securing fastener members along selected edges in superimposed positions on outer and inner sides of said pockets;

engaging said inner side fastener members of selected of said pockets with said first fastener members of selected of said units and engaging said outer side fastener members of said pockets with said second fastener members of said selected said unit; whereby, said pocket is securely and releasably secured with said garment.

11. The method of claim 10 providing said fastener members are hook and loop fastener members.

12. The method of claim 11 including providing said hook fastener members as said first fastener members and said outer side fastener members and providing said loop fastener members as said second fastener members and said inner side fastener members.

13. A system for interchangeably connecting pockets with a selective support member comprising:

a plurality of attachment units arranged in selected locations over said support member, each said attachment unit comprising a plurality of tabs including a pair of vertically extending tabs and at least one horizontally extending tab arranged intermediate said vertically extending tabs, said tabs carrying a plurality of fastener members;

a plurality of pockets each having a plurality of superimposed fastener members on each of its outer and inner sides adjacent selected edges; whereby, said fastener members of said tabs are simultaneously engaged with said superimposed fastener members on said inner and outer sides of said pockets when said pockets are united with said support member.

14. The system of claim 13 wherein said fastener members comprise hook and loop fasteners.

15. The system of claim 14 wherein said pockets may be simultaneously attached with between one and all of said attachment units.

* * * * *